US006713704B1

(12) United States Patent
Yu

(10) Patent No.: US 6,713,704 B1
(45) Date of Patent: Mar. 30, 2004

(54) PUSHBUTTON ASSEMBLY

(76) Inventor: Tsung-Mou Yu, No. 4, Alley 2, Lane 23, Sec. 3, Pa Te Rd., Panchiao City, Taipei Hsien (TW)

( * ) Notice: Subject to any disclaimer, the term of this patent is extended or adjusted under 35 U.S.C. 154(b) by 0 days.

(21) Appl. No.: 10/358,030

(22) Filed: Feb. 3, 2003

(51) Int. Cl.[7] ..... H01H 37/02; H01H 13/14; H01H 71/16

(52) U.S. Cl. ..... 200/520; 200/341; 337/37; 337/66

(58) Field of Search ..... 200/520, 523–529, 200/533, 535, 553, 557–561; 337/1, 3, 12–16, 37, 58–61, 66, 112, 113, 140, 332–337, 345, 379

(56) References Cited

U.S. PATENT DOCUMENTS

| | | | | |
|---|---|---|---|---|
| 4,167,720 A | | 9/1979 | Krasser | 337/60 |
| 4,937,548 A | | 6/1990 | Sdunek | 337/70 |
| 5,233,813 A | | 8/1993 | Kenney et al. | 53/450 |
| 5,451,729 A | | 9/1995 | Onderka et al. | 200/18 |
| 5,558,211 A | | 9/1996 | Heydner et al. | 200/553 |
| 6,154,116 A | * | 11/2000 | Sorenson | 337/37 |
| 6,275,133 B1 | * | 8/2001 | Chen | 337/37 |
| 6,307,459 B1 | * | 10/2001 | Yu | 337/37 |
| 6,335,500 B1 | * | 1/2002 | Chi et al. | 200/341 |
| 6,417,756 B1 | * | 7/2002 | Yu | 337/66 |
| 6,445,275 B2 | * | 9/2002 | Yu | 337/68 |
| 6,512,441 B1 | * | 1/2003 | Yu | 337/37 |
| 6,617,952 B1 | * | 9/2003 | Yu | 337/94 |

* cited by examiner

*Primary Examiner*—Michael A. Friedhofer

(57) ABSTRACT

A pushbutton assembly includes a housing and a button slidable with respect to the housing. A positioning disk is pivotally connected to the housing and has a positioning hole to receive therein a bent of a positioning rod which is pivotally connected to the button. After a resilient plate is connected to two first contacts of a first terminal, the resilient plate is deformed. The resilient plate further has a contact selectively connected to a second contact which is received in the housing such that movement of the button drives the bent to reciprocally move from a first position to a second position so that a reaction plate of the resilient plate is reciprocally deformed to selectively connect the contact to the first contact.

19 Claims, 8 Drawing Sheets

PUSHBUTTON ASSEMBLY

FIELD OF THE INVENTION

The present invention relates to a pushbutton assembly, and more particularly to a pushbutton assembly having a positioning rod rotatably connected to a button and a positioning disk pivotally received in a housing of the pushbutton assembly and having a positioning hole defined in the positioning disk to receive therein a bent of the positioning rod such that repeated up and down movement of the button allows the bent to be positioned at a first position and a second position within the positioning hole to accomplish the designed purpose of the pushbutton assembly.

BACKGROUND OF THE INVENTION

U.S. Pat. Nos. 4,167,720; 4,937,548; 5,233,813; 5,451,729; 5,558,211 are numerous patents related to a pushbutton assembly, which all suffer from the following shortcomings:

Too many linking parts are involved in a single movement, which causes a complex process to accomplish a single purpose and a non-real-time action; and Because the quantity of the parts to accomplish a single action is large, possibility of malfunction is great and the quality of communication between parts is low.

With reference to FIG. 1, a conventional pushbutton assembly is shown to have a button (601) and a housing (606).

The button (601) is mounted on top of a body (not numbered) having a V-shaped protrusion (603) which is formed on a bottom of a channel (602) and has a lowermost point (a). The channel (602) has a lowermost point (b). A positioning rod (604) has a first end inserted into the through hole (607) in the housing (606) and a second end (605) extending into the channel (602). A spring (608) is employed to provide a resilience to the button (601) and to ensure that the second end of the positioning rod (604) to abut an inner face of the channel (602).

When the user presses the button (601), the second end of the positioning rod (604) moves from point (a) to point (b). When the user pushes the button (601) again, the second end of the positioning rod (604) moves from point (b) to point (a). When the pushbutton assembly is used for a period of time, the resilience of the spring (608) is deteriorated, the engagement of the second end (605) of the positioning rod (604) with the inner face of the channel (602) is not secured. Therefore, it is noted that the second end (605) of the positioning rod (604) may deviate from point (a) if the resilience from the spring (608) is not enough. Another shortcoming from the insufficient resilience is that the contact (610) of the electrical plate (609) may not engage with the contact (612) of the pin (611) properly and thus causes malfunction.

Accordingly, the conventional pushbutton assembly uses too many parts so that the cost is high and the possibility of having malfunction is thus high.

In order to obviate the shortcoming described in FIG. 1, U.S. Pat. No. 5,223,813 discloses an indirect contact between the button and the resilient plate. This indirect engagement between the button and the resilient plate does provide improvements over the prior art. However, there are too many parts involved in the structure and thus manufacture cost is high and the drawback of metal fatigue still bothers the operator.

To overcome the shortcomings, the present invention tends to provide an improved pushbutton assembly to mitigate and obviate the aforementioned problems.

SUMMARY OF THE INVENTION

The primary objective of the present invention is to provide an improved pushbutton assembly having a positioning rod rotatably connected to a button and a positioning disk pivotally received in a housing of the pushbutton assembly and having a positioning hole defined in the positioning disk to receive therein a bent of the positioning rod such that repeated up and down movement of the button allows the bent to be positioned at a first position and a second position within the positioning hole to accomplish the designed purpose of ON/OFF function of a resilient plate of the pushbutton assembly.

Other objects, advantages and novel features of the invention will become more apparent from the following detailed description when taken in conjunction with the accompanying drawings.

DETAILED DESCRIPTION OF THE INVENTION

Figure 1:
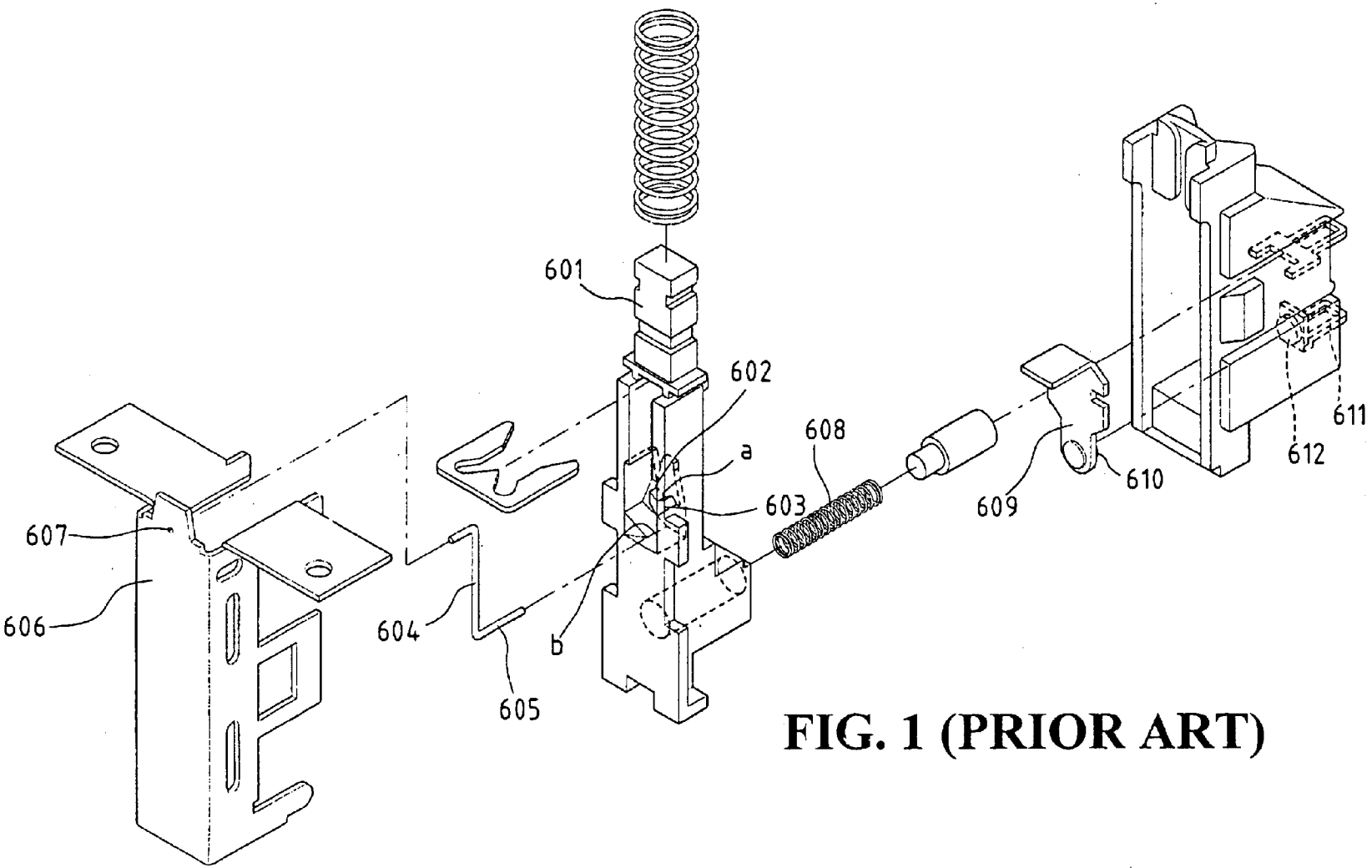
FIG. 1 (PRIOR ART)
FIG. 1 is an exploded perspective view of a conventional pushbutton assembly.
Figure 2:
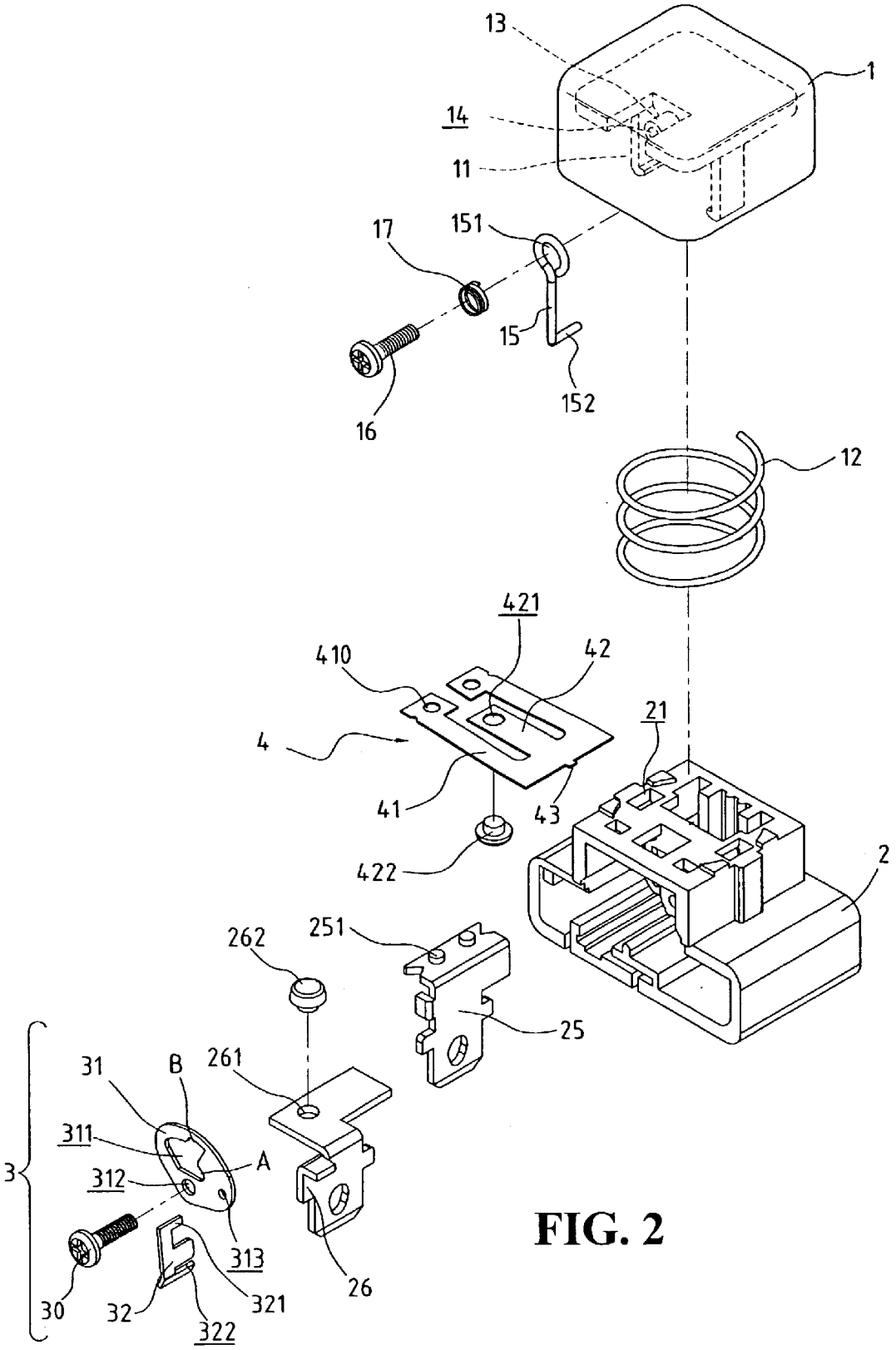
FIG. 2 is an exploded perspective view of the pushbutton assembly of the present invention.
Figure 3:
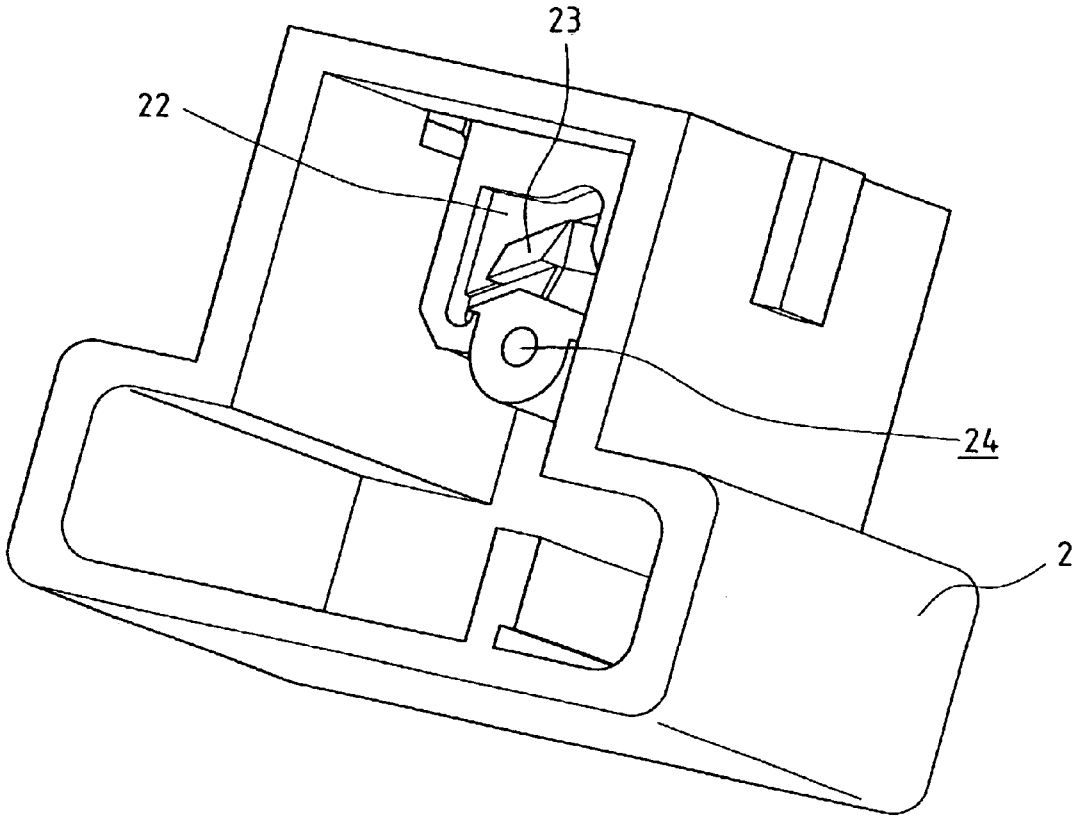
FIG. 3 is a perspective view of the housing of the pushbutton assembly in FIG. 1.

With reference to FIGS. 2 and 3, the pushbutton assembly of the present invention includes a button (1), a housing (2), a positioning device (3) and a resilient plate (4).

The button (1) has extensions (11) integrally formed on a bottom face of the button (1). A first resilient element (12) (preferably a spring) is received in the button (1) and an assembly rod (13) is formed on a side face of the button (1) and has an assembly hole (14). A positioning rod (15) has a hole (151) formed on a free end of the positioning rod (15) and a bent (152) formed on the other free end of the positioning rod (15). A bolt (16) is provided to correspond to the hole (151) and the assembly hole (14). A small spring (17) is provided to be mounted on the bolt (16).

The housing (2) has apertures (21) defined in an outer face of the housing (3) to correspond to the extensions (11), a step (22) formed inside the housing (2), a slanted face (23) formed on the step (22) and an assembly slot (24). At least two terminals, the first terminal and the second terminal (25,26) are provided on the bottom face of the housing (2).

The first terminal (25) has two first contacts (251) and the second terminal (26) has a second contact (261) received in a contact hole (261) defined on top of the second contact (26).

A positioning device (3) is composed of a positioning disk (31) and a driven plate (32). The positioning disk (31) has a positioning hole (311), a pivot hole (312) corresponding to the assembly slot (24) of the housing (2) and a through hole (313). The positioning hole (311) has a first cutout (A) and a second cutout (B) respectively defined along a peripheral edge defining the positioning hole (311) to correspond to the bent (152) of the positioning rod (15). The driven plate (32) has a protrusion (321) extending out to correspond to the through hole (313) of the positioning disk (31) and a notch (322) defined in a lower portion of the driven plate (32). A bolt (30) is provided to be extending through the pivot hole (312) of the positioning disk (31).

The resilient plate (4) is a dual metal plate and has two legs (41) and a reaction plate (42) sandwiched between the two legs (41). Each of the two legs (41) has a contact hole (410) defined in a free end of each of the legs (41) to correspond to the two first contacts (251) of the first terminal (25). A distance between the two contact holes (410) is slightly larger than a distance between the two first contacts (251) so that when the two first contacts (251) are received in the two corresponding contact holes (410), the resilient plate (4) is bent. A contact (422) is received in a second contact hole (421) in the reaction plate (42). A boss (43) is formed on a free side of the resilient plate (4) to correspond to the notch (322) of the driven plate (32).

Figure 4:
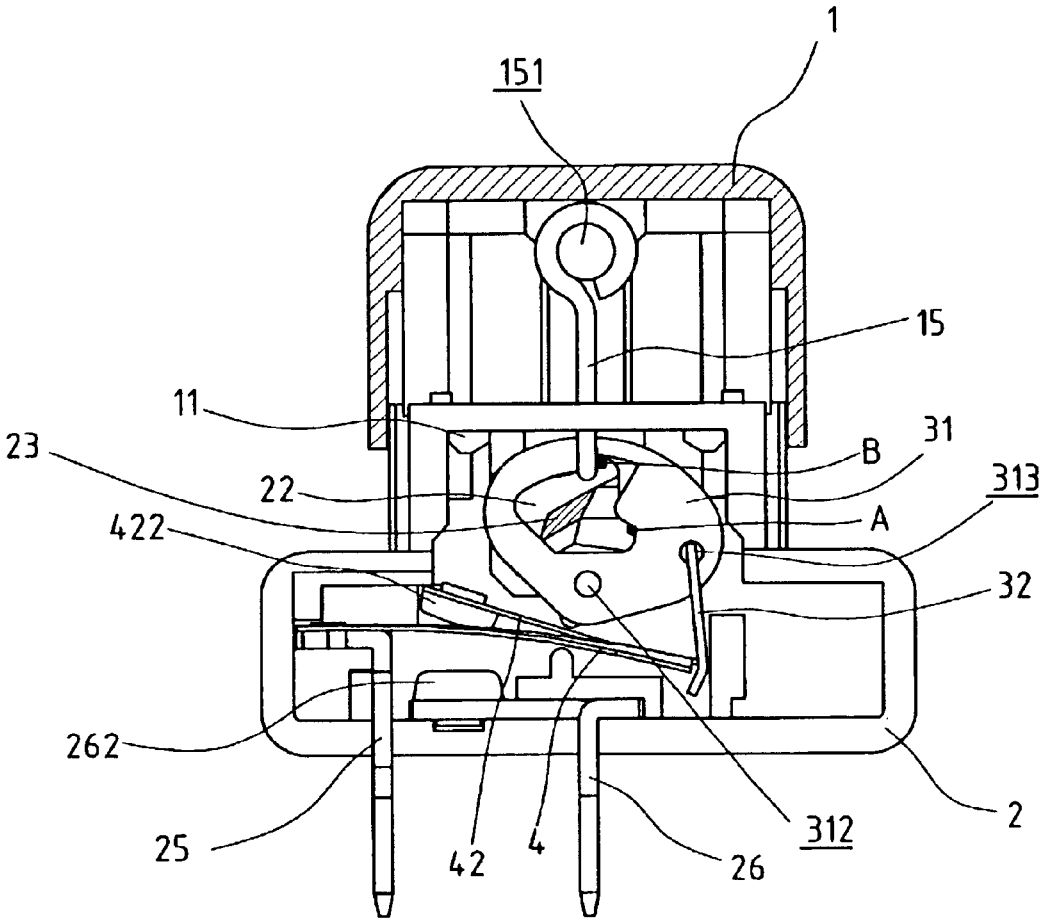
FIG. 4 is a schematic view showing the pushbutton assembly in FIG. 1 is assembled.

With reference to FIG. 4, when the pushbutton assembly of the present invention is in assembly, the positioning rod (15) is pivotally connected to the button (1) by the bolt (16) extending through the hole (151) and into the assembly hole (14) of the button (1), wherein the small spring (17) is mounted on the bolt (16) to urge the positioning rod (15) to maintain the positioning rod (15) to point to a certain orientation. Meanwhile, the bent (152) extends through the positioning hole (311) and into the step (22) of the housing (2).

The spring (12) is sandwiched between the button (1) and the housing (2) to provide the button (1) a resilience to bounce the button (1) once the button (1) is moved toward the housing (2). The first terminal (25) and the second terminal (26) are securely mounted on the bottom of the housing (2) with the first contacts (251) and the second contact (262) facing upward. The second bolt (30) extends through the pivot hole (312) of the positioning disk (31) and into the assembly hole (24) of the housing (2) to pivotally connect the positioning disk (31) to the housing (2). The protrusion (321) extends into the through hole (313) and the boss (43) is received in the notch (322). It is noted that after the assembly of the pushbutton assembly of the present invention, the contact (422) is selectively engaged with the second contact (262).

Figure 5:
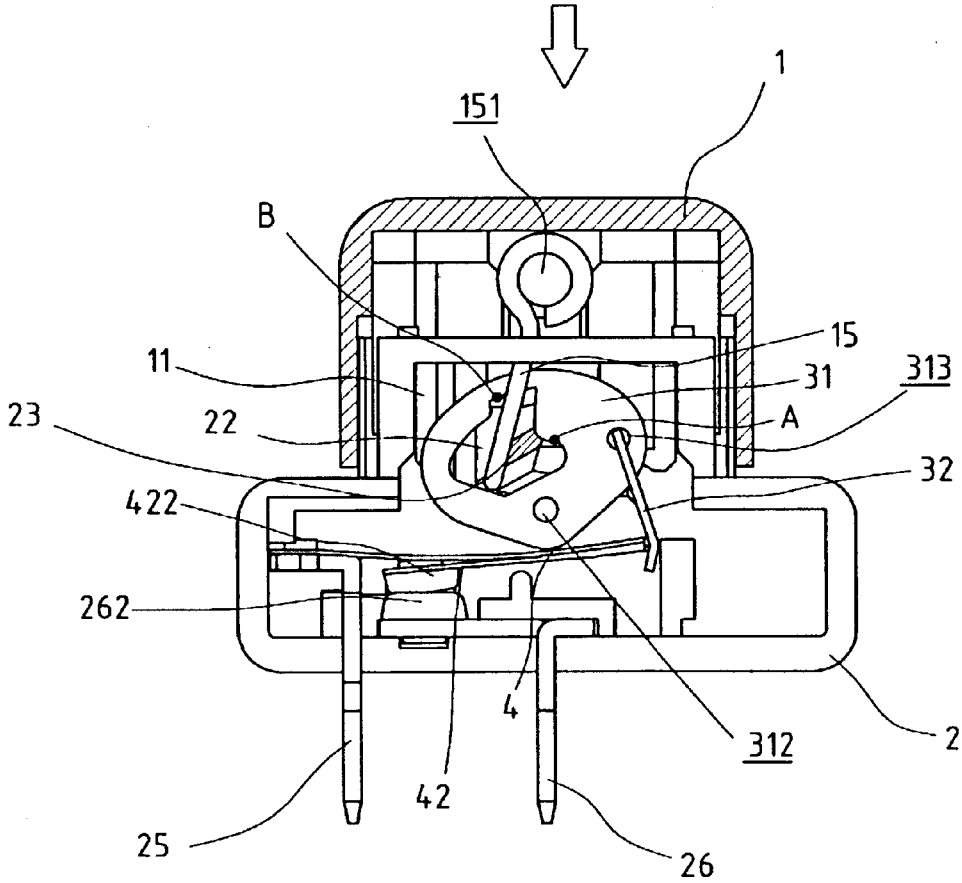
FIG. 5 is a schematic view showing that when the button is pressed downward, the positioning disk is pivoted by the positioning rod.
Figure 6:
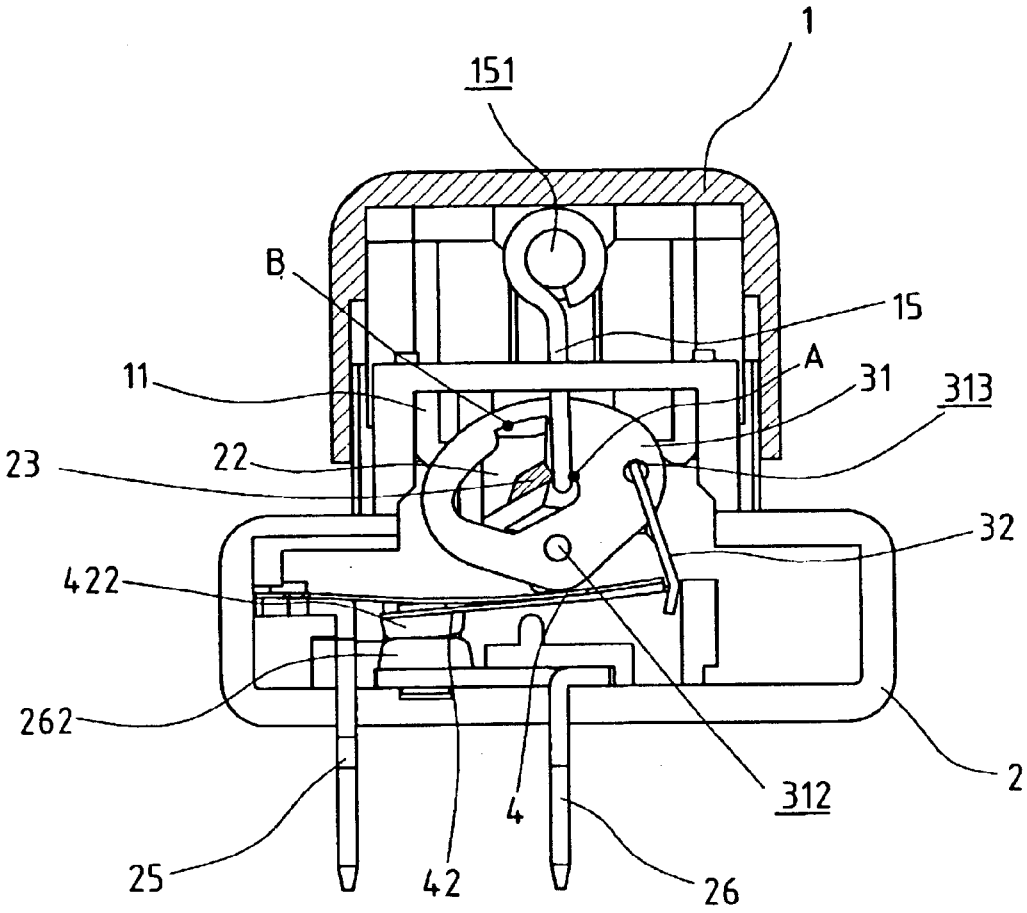
FIG. 6 is a schematic view showing that the positioning rod is positioned at a first position within the positioning disk to complete the engagement between the contact and the second contact point.

With reference to FIG. 5, when the button (1) is pressed downward, the positioning rod (15) is driven to pivot. The bent (152) on the step (22) moves along the slanted face (23) to the bottom of the slanted face (23). Because the bent (152) is received in the positioning hole (311), the pivotal movement of the positioning rod (15) drives the positioning disk (31) to pivot to the left. As a result of the pivotal movement of the positioning disk (31), a periphery of the first cutout (A) engages with a periphery of the slanted face (23) to form a stop to secure the bent (152). Furthermore, because of the leftward pivotal movement of the positioning disk (31), the driven plate (32) is driven to ascend, which causes the reaction plate (42) to bend downward. Therefore, the contact (422) engages with the second contact (262) to complete a circuit, as shown in FIG. 6.

Figure 7:
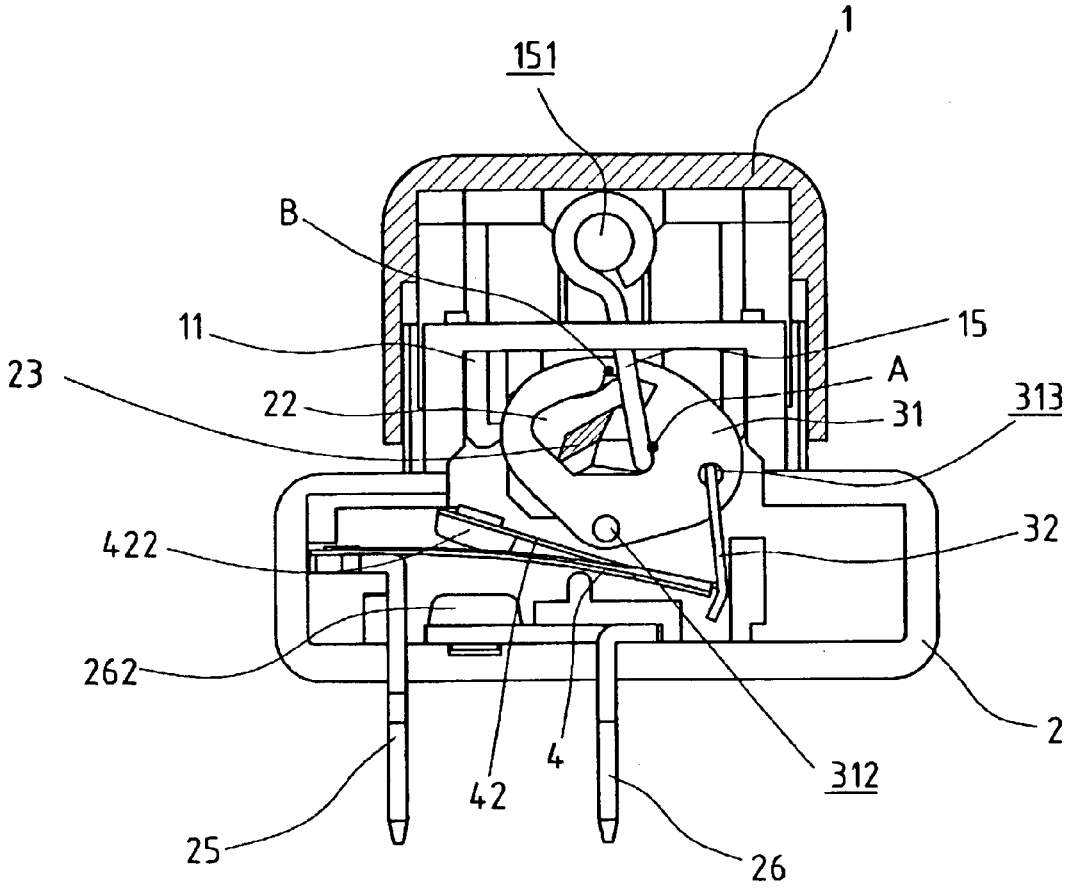
FIG. 7 is a schematic view showing that the positioning disk is pivoted again to the right due to the downward movement of the button to disengage the contact and the second contact point.
Figure 8:
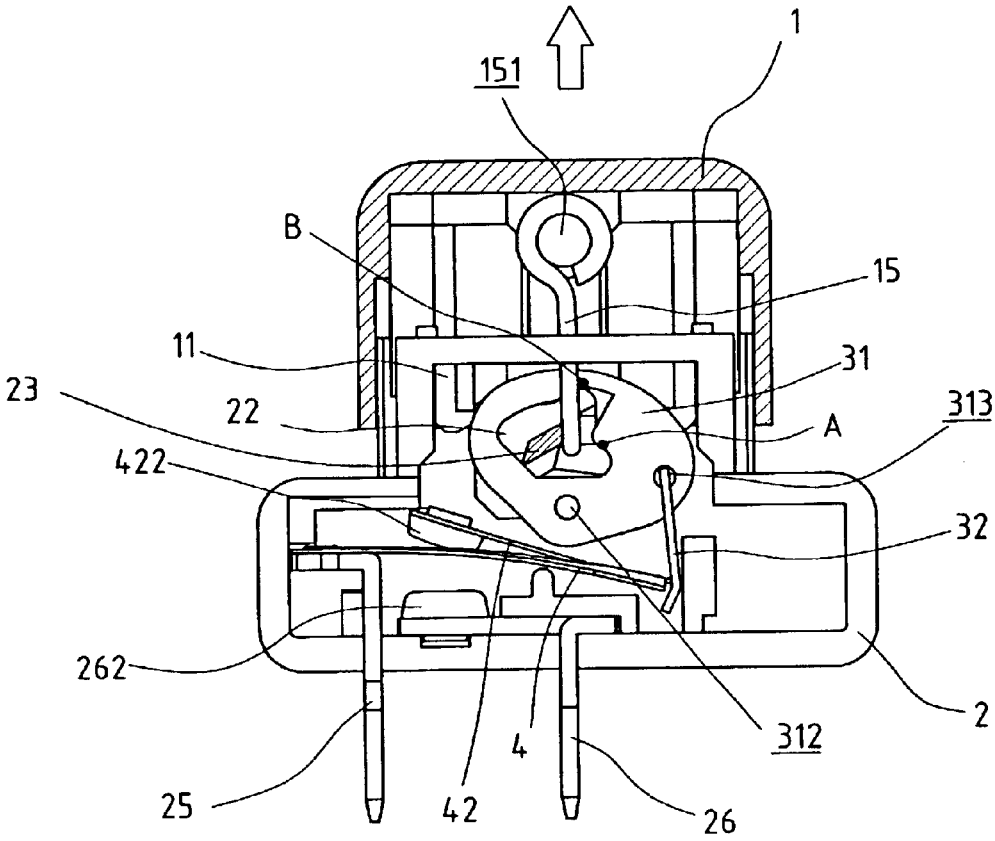
FIG. 8 is a schematic view showing that after the positioning disk is pivoted to the right, the positioning rod is released from the first position and moves to the second position, which completes the disengagement between the contact and the second contact point.

With reference to FIGS. 7 and 8, when the operator pushes the button (1) again, the positioning rod (15) is thus driven again and the positioning disk (31) is accordingly pivot to the right, which results in that the stop formed by the slanted face (23) and the first cutout (A) in the positioning hole (311) releases the limit to the positioning rod (15). With the resilience of the spring (12), the upward movement of the button (1) drives the positioning rod (15) to move upward as well. When the positioning rod (15) moves upward, the bent (152) moves to the second cutout (B) and is secured.

While the positioning disk (31) pivots to the right due to the downward movement of the button (1), the driven plate (32) is driven to decent, which causes the boss (43) of the resilient plate (4) to move downward accordingly. Therefore, the reaction plate (42) moves in an opposite direction and thus causes the contact (422) of the reaction plate (42) to disengage with the second contact (262), as shown in FIG. 8.

Referring to FIG. 7 again, when the pushbutton assembly of the present invention is ON, the contact (422) engages with the second contact (262), and there is an overload in the pushbutton assembly, the resilient plate (4) is heated and thus the reaction plate (42) bends upward to disengage with the second contact (262). Meanwhile, due to the downward movement of the boss (43), the driven plate (32) is driven to move downward as well. Therefore, the positioning disk (31) pivots to the right to release the limit to the bent (152) of the positioning rod (15) and thus the positioning rod (15) is able to move from the first cutout (A) to the second cutout (B) by the resilience of the spring (12).

Therefore, with the feature of the resilient plate (4), the pushbutton assembly of the present invention is able to complete a circuit and then break the circuit automatically if there is an overload. Furthermore, the up and down movement of the button (1) drives the bent (152) of the positioning rod (15) to move from the first position to the second position or vice versa.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a pushbutton assembly having a housing and a button movable with respect to the housing, wherein the improvement comprise:

an assembly rod is adapted to be formed in the button;

a positioning rod is pivotally connected to the assembly rod and has a bent;

a slanted face is formed on top of a step which is adapted to be formed inside the housing;

a first terminal and a second terminal are adapted to be mounted on a bottom of the housing and the first terminal has two first contacts and the second terminal has a second contact;

a positioning disk is adapted to be pivotally connected to the housing and has a positioning hole to receive therein the bent of the positioning rod; and a resilient plate adapted to be received in the housing and composed of two legs and a reaction plate sandwiched between the two legs is movably connected to the positioning disk and has a contact formed on the reaction plate, whereby movement of the positioning rod drives the positioning disk to pivot, which drives the resilient plate to deform to selectively engage the contact of the reaction plate with the second contact to complete a cycle of a pushbutton assembly.

2. The pushbutton assembly as claimed in claim 1, wherein the two legs of the resilient plate respectively have a contact hole defined to correspond to the two first contacts of the first terminal and to receive the two first contacts in the two contact holes.

3. The pushbutton assembly as claimed in claim 2, wherein a distance between the two contact holes is smaller than a distance between the two first contacts such that after the two first contacts are received in the two contact holes of the legs, the resilient plate is deformed.

4. The pushbutton assembly as claimed in claim 3, wherein the movement of the button drives the bent to reciprocally move from a first position to a second position.

5. The pushbutton assembly as claimed in claim 4 further comprising a driven plate securely connecting the positioning disk to the resilient plate so that pivotal movement of the positioning disk drives the resilient plate to deform.

6. The pushbutton assembly as claimed in claim 5, wherein the driven plate has a protrusion formed to correspond to a through hole in the positioning disk and a notch defined to correspond to a boss formed on the resilient plate.

7. The pushbutton assembly as claimed in claim 6, wherein the resilient plate is a dual metal plate.

8. The pushbutton assembly as claimed in claim 5, wherein the resilient plate is a dual metal plate.

9. The pushbutton assembly as claimed in claim 4, wherein the resilient plate is a dual metal plate.

10. The pushbutton assembly as claimed in claim 3 further comprising a driven plate securely connecting the positioning disk to the resilient plate so that pivotal movement of the positioning disk drives the resilient plate to deform.

11. The pushbutton assembly as claimed in claim 10, wherein the driven plate has a protrusion formed to correspond to a through hole in the positioning disk and a notch defined to correspond to a boss formed on the resilient plate.

12. The pushbutton assembly as claimed in claim 3, wherein the resilient plate is a dual metal plate.

13. The pushbutton assembly as claimed in claim 2, wherein the movement of the button drives the bent to reciprocally move from a first position to a second position.

14. The pushbutton assembly as claimed in claim 1, wherein the movement of the button drives the bent to reciprocally move from a first position to a second position.

15. The pushbutton assembly as claimed in claim 1 further comprising a driven plate securely connecting the positioning disk to the resilient plate so that pivotal movement of the positioning disk drives the resilient plate to deform.

16. The pushbutton assembly as claimed in claim 15, wherein the driven plate has a protrusion formed to correspond to a through hole in the positioning disk and a notch defined to correspond to a boss formed on the resilient plate.

17. The pushbutton assembly as claimed in claim 16, wherein the resilient plate is a dual metal plate.

18. The pushbutton assembly as claimed in claim 15, wherein the resilient plate is a dual metal plate.

19. The pushbutton assembly as claimed in claim 1, wherein the resilient plate is a dual metal plate.

* * * * *